US006155320A

United States Patent [19]

Finke et al.

[11] Patent Number: 6,155,320

[45] Date of Patent: Dec. 5, 2000

[54] METHOD AND APPARATUS FOR INJECTING STEAM AT A SINGLE FACER BONDING NIP

[75] Inventors: Joseph L. Finke, Maryland; Kent W. Thurston, Timonium; Charles E. Thomas, Reisterstown, all of Md.; Stephen Joseph Mettee, New Freedom, Pa.

[73] Assignee: United Container Machinery, Inc., Glen Arm, Md.

[21] Appl. No.: 09/065,349

[22] Filed: Apr. 23, 1998

Related U.S. Application Data

[60] Provisional application No. 60/044,104, Apr. 24, 1997.

[51] Int. Cl.[7] ..... B31F 01/20

[52] U.S. Cl. ..... 156/472

[58] Field of Search ..... 156/205, 210, 156/462, 470, 472

[56] References Cited

U.S. PATENT DOCUMENTS

| | | | |
|---|---|---|---|
| 545,354 | 8/1895 | Ferres . | |
| 972,121 | 10/1910 | McPike et al. . | |
| 1,609,318 | 12/1926 | Smith . | |
| 2,236,056 | 3/1941 | Grimm | 154/32 |
| 2,638,962 | 5/1953 | Nitchie | 154/31 |
| 3,340,125 | 9/1967 | Drenning et al. | 156/274 |
| 3,434,901 | 3/1969 | Griffiths et al. | 156/210 |
| 3,981,758 | 9/1976 | Thayer et al. | 156/64 |
| 4,268,341 | 5/1981 | Huhne | 156/353 |
| 4,310,375 | 1/1982 | Seki | 156/462 |
| 4,316,761 | 2/1982 | Hirakawa et al. | 156/472 |
| 4,337,884 | 7/1982 | Hirakawa et al. | 226/52 |
| 4,338,154 | 7/1982 | Berthelot et al. | 156/462 |
| 4,348,250 | 9/1982 | Bromley | 156/473 |
| 4,381,212 | 4/1983 | Roberts | 156/473 |
| 4,419,173 | 12/1983 | Akiyama et al. | 156/470 |
| 4,483,770 | 11/1984 | Casey et al. | 210/401 |
| 4,836,429 | 6/1989 | Nakashima et al. | 226/7 |
| 4,889,580 | 12/1989 | Seki et al. | 156/382 |
| 4,917,664 | 4/1990 | Lacaux | 493/470 |
| 4,932,139 | 6/1990 | Lehtinen | 34/41 |
| 4,947,559 | 8/1990 | Basler et al. | 34/70 |
| 5,156,714 | 10/1992 | Thomas | 156/472 |
| 5,181,330 | 1/1993 | Schoch | 34/162 |
| 5,183,525 | 2/1993 | Thomas | 156/470 |
| 5,259,124 | 11/1993 | Poterala | 34/155 |
| 5,419,796 | 5/1995 | Miller | 156/207 |
| 5,449,431 | 9/1995 | Isowa | 156/472 |
| 5,480,086 | 1/1996 | Nakashima et al. | 226/97 |
| 5,495,092 | 2/1996 | Marschke et al. | 219/388 |
| 5,501,762 | 3/1996 | Marschke et al. | 156/470 |
| 5,614,048 | 3/1997 | Barny et al. | 156/205 |
| 5,628,865 | 5/1997 | Marschke | 156/473 |
| 5,630,903 | 5/1997 | Knorr et al. | 156/472 |
| 5,656,124 | 8/1997 | Krayenhagen et al. | 156/359 |
| 5,766,410 | 6/1998 | Wu | 156/472 |

*Primary Examiner*—Michael W. Ball
*Assistant Examiner*—Gladys Piazza
*Attorney, Agent, or Firm*—Biebel & French

[57] ABSTRACT

An apparatus and related method for forming a single face paperboard web are disclosed. The apparatus of the present invention includes a forming corrugating roll for corrugating flutes on a medium web and a carrier corrugating roll operably connected to the forming corrugating roll for carrying the medium web into contact with a liner web. A bonding nip is defined by the carrier corrugating roll for pressing the liner web into adhering contact with the medium web, thereby forming a single faced web. A steam supplying device, including at least one fluid port in fluid communication with the bonding nip, supplies a low pressure steam against at least one of the liner web and the medium web. The steam supplying device further includes a body having a heated surface facing one of the liner and the medium webs. A primary channel extends within the body and is in thermal communication with the heated surface. A high pressure steam is supplied to the primary channel for heating the heated surface. A plurality of secondary channels extend within the body and are in fluid communication with the plurality of fluid ports. A low pressure steam is supplied to the secondary channels for release by the plurality of fluid ports within the bonding nip to assist in the rapid gelatinization of glue between the liner and medium webs.

33 Claims, 15 Drawing Sheets

METHOD AND APPARATUS FOR INJECTING STEAM AT A SINGLE FACER BONDING NIP

CROSS-REFERENCE TO RELATED APPLICATION

This application claims the benefit of U.S. Provisional Patent Application No. 60/044,104, filed Apr. 24, 1997.

BACKGROUND OF THE INVENTION

1. Field of the Invention

The present invention relates to a method and apparatus for manufacturing corrugated paperboard, and more particularly, to a method and apparatus for injecting steam at the bonding nip of a single facer to accelerate the gelatinization of glue between a liner web and a medium web.

2. Description of the Prior Art

The manufacturing of double face corrugated paperboard typically begins with an apparatus known as a single facer. A conventional single facer includes an upper corrugating roll and a lower corrugating roll wherein each roll has a plurality of longitudinally extending teeth. The corrugating rolls are rotatably mounted adjacent each other such that the teeth of each roll are in a meshing relationship. A medium paperboard web is fed into a corrugating nip defined by the upper and lower corrugating rolls wherein the medium web conforms to the contour of the meshing teeth to form flutes in the medium web. Prior to entering the corrugating nip, the medium web typically passes over a preheater for increasing the temperature of the web.

The preheater typically comprises a steam pressurized drum heater having an internal cavity supplied with steam from an external source. The medium web is wrapped around a portion of the outer circumference of the drum and heat from the surface of the drum is transferred to the moving medium web.

A gluing roll, arranged to turn in a bath of starch-based glue, is positioned downstream from the corrugating nip and applies glue to the tips of the medium web flutes. The glue applied to the flutes of the paperboard webs is typically a suspension of raw or uncooked starch in a suitable liquid carrier. In this state, the starch has little or no adhesive qualities. However, at a certain temperature, dependent upon the type of starch utilized and the kind and amount of additives dissolved in the carrier, the starch granules will absorb the available liquid of suspension and swell, causing gelatinization of the suspension. In this gelatinized state the starch has superior adhesion abilities and will form a good bond between many substrates, including paper. The temperature at which gelatinization occurs for any particular formulation of glue can be easily determined by heating the particular formulation and observing the changes that occur in its viscosity.

As glue is applied to the paperboard medium web, a paperboard liner web is simultaneously supplied to a preheater having a design similar to that of the medium web preheater. Both the liner web and medium web preheaters depend on conduction for heat transfer to the respective paperboard web. Conduction heat transfer is directly related to the surface area of the paperboard web contacting the preheater, the duration of such contact and the temperature gradient between the preheater and the web. In order to provide sufficient heat transfer, the web preheaters must therefore define a relatively large surface area and the processing speed of the single facer must be limited.

The large surface area required of prior art preheaters substantially increases the overall size of the single facer. In fact, such preheaters are often so large that the preheater must be placed exterior to, and many times behind, the corrugating apparatus. Further, frictional forces opposing the movement of the liner and medium webs are substantially increased the greater the wrap angle around the outer surface of the preheater. Such frictional forces generate tension within the webs, often resulting in web breakage. Prior art attempts to eliminate such problems generated by friction have resulted in complex mechanical arrangements including rotatable preheater drums and variable wrap mechanisms.

The conventional single facer further includes a pressure roll arranged adjacent the lower corrugating roll for bringing the liner web into engagement with the glued flute tips of the medium web. The pressure roll and corrugating roll define a pressure nip for applying a pressure to the corrugated medium web and the liner web, whereby an initial bond is formed therebetween. While both webs are typically preheated to a predetermined temperature, additional heat is transferred to the webs by the pressure roll and lower corrugating roll. This combination of heat and pressure gelatinizes the glue between the medium web and liner web thereby forming a single face web of corrugated paperboard.

The pressure roll and corrugating roll are typically heated by high pressure steam passing through an internal channel. The high pressure steam heats the cylindrical walls of the rolls such that heat is transferred to the webs through conduction. This conduction heat transfer from the rolls is directly related to the surface area of the paperboard web contacting the roll, the duration of such contact, and the temperature gradient between the roll and the web.

Effective bonding of the medium web and liner web further depends upon the pressing duration and pressing force exerted by the pressure roll to force the webs together in an intimate relationship until a secure bond is formed by the gelatinization of the glue. The pressing duration is directly related to the length of the pressing nip and processing speed of the single facer. If the nip length is decreased while maintaining a constant processing speed then the pressing force must be increased to provide effective bonding. However, if the pressing force is decreased and the processing speed held constant then effective bonding necessitates that the nip length be increased.

Traditional pressure rolls provide a small nip length for acting against the medium web and the liner web, thereby necessitating a high pressing force. Such a high pressing force between the pressure roll and lower corrugating roll typically results in linear press marks, corresponding to the pitch of the teeth of the lower corrugating roll, being formed laterally on the surface of the liner web. Further, such a high pressure may weaken the liner web. The single face web produced by the prior art single facers therefore often have an unattractive appearance or are rejected as being defective.

In response to the above-noted problems, it has been proposed to replace the conventional pressure roll with an endless belt having a portion wrapped about the lower corrugating roll thereby forming an extended nip for pressing the liner web together with the medium web. More specifically, the endless belt is extended over a plurality of rolls to run freely in cooperation with the lower corrugating roll wherein the liner web and the corrugated medium web pass between the lower corrugating roll and the endless belt and are nipped therebetween.

A common problem associated with the prior art single facers employing such an endless belt is that the belt cannot provide sufficient pressing force given the available nip length to provide effective bonding of the liner web and the corrugated medium web. While the tension in the belt may be increased to thereby increase the pressing force, this tension is limited based upon the properties of the belt. Excessive tension in the belt may cause accelerated wear or tearing of the belt.

Accordingly, there is a need for a method and apparatus for providing an adequate bond between a medium web and a liner web to produce a single face web without damaging the liner web. Further, there is a need for such a method and apparatus for facilitating rapid gelatinization of the glue between the medium web and the liner web.

SUMMARY OF THE INVENTION

The present invention provides a method and apparatus for accelerating the gelatinization of a glue between paperboard webs by the application of a heated fluid to a bonding nip defined for pressing the webs into adhering contact.

The method of the present invention includes the steps of providing a corrugating nip and passing a paperboard medium web through the corrugating nip to form a plurality of flutes within the medium web. The method further includes the steps of applying glue to the plurality of flutes of the medium web and providing a bonding nip for pressing a paperboard liner web into adhering contact with the medium web. A heated surface is provided facing the bonding nip and is in thermal communication with at least one primary channel. High pressure steam is supplied to the at least one primary channel for heating the heated surface.

A plurality of fluid ports are provided in fluid communication with the heated surface and the bonding nip. At least one secondary channel is provided in spaced relation to the at least one primary channel wherein steam is supplied to the at least one secondary channel for release through the plurality of fluid ports toward the glue between the liner and the medium webs. The steam supplied to the at least one secondary channel preferably comprises a low pressure dry steam.

The apparatus of the present invention comprises a single facer including a forming corrugating roll for corrugating flutes on a paperboard medium web. A carrier corrugating roll is operably connected to the forming corrugating roll for carrying the medium web into contact with a paperboard liner web. A glue applicator cooperates with the carrier corrugating roll for applying glue to the flutes of the medium web. A bonding nip is defined by the carrier corrugating roll for pressing the liner web into adhering contact with the flutes of the medium web, thereby forming a single face web.

A steam supplying device is positioned adjacent the bonding nip and includes a plurality of fluid ports in fluid communication with the bonding nip for supplying a steam against at least one of the liner and medium webs. The steam supplying device further includes a body having a heated surface extending circumferentially from proximate a point of initial contact between the liner and medium webs to proximate a point of divergence of the single face web from the carrier corrugating roll. At least one primary channel extends between opposite ends of the body and is in thermal communication with the heated surface. A first inlet port is in fluid communication with the at least one primary channel for supplying a high pressure steam thereto for heating the heated surface.

A plurality of secondary channels extend parallel to the at least one primary channel and are in fluid communication with the plurality of fluid ports communicating with the bonding nip. A second inlet port is in fluid communication with the plurality of secondary channels for providing a low pressure steam to the secondary channels from an external steam source. The low pressure steam travels through the secondary channels and exits through the fluid ports. The steam is thereby released against one of the liner and medium webs at the bonding nip to facilitate rapid gelatinization of the glue and formation of the final bond between the webs.

Therefore, it is an object of the present invention to provide a method and apparatus for increasing the gelatinization and bonding rate of glue between paperboard webs.

It is a further object of the present invention to provide a method and apparatus of bonding paperboard webs with reduced pressing force applied to the webs.

It is another object of the present invention to provide a method and apparatus of bonding a medium web and a liner web so as to reduce marking and damage to the resulting single face web.

Other objects and advantages of the invention will be apparent from the following description, the accompanying drawings and the appended claims.

DETAILED DESCRIPTION OF THE PREFERRED EMBODIMENT

Figure 1:
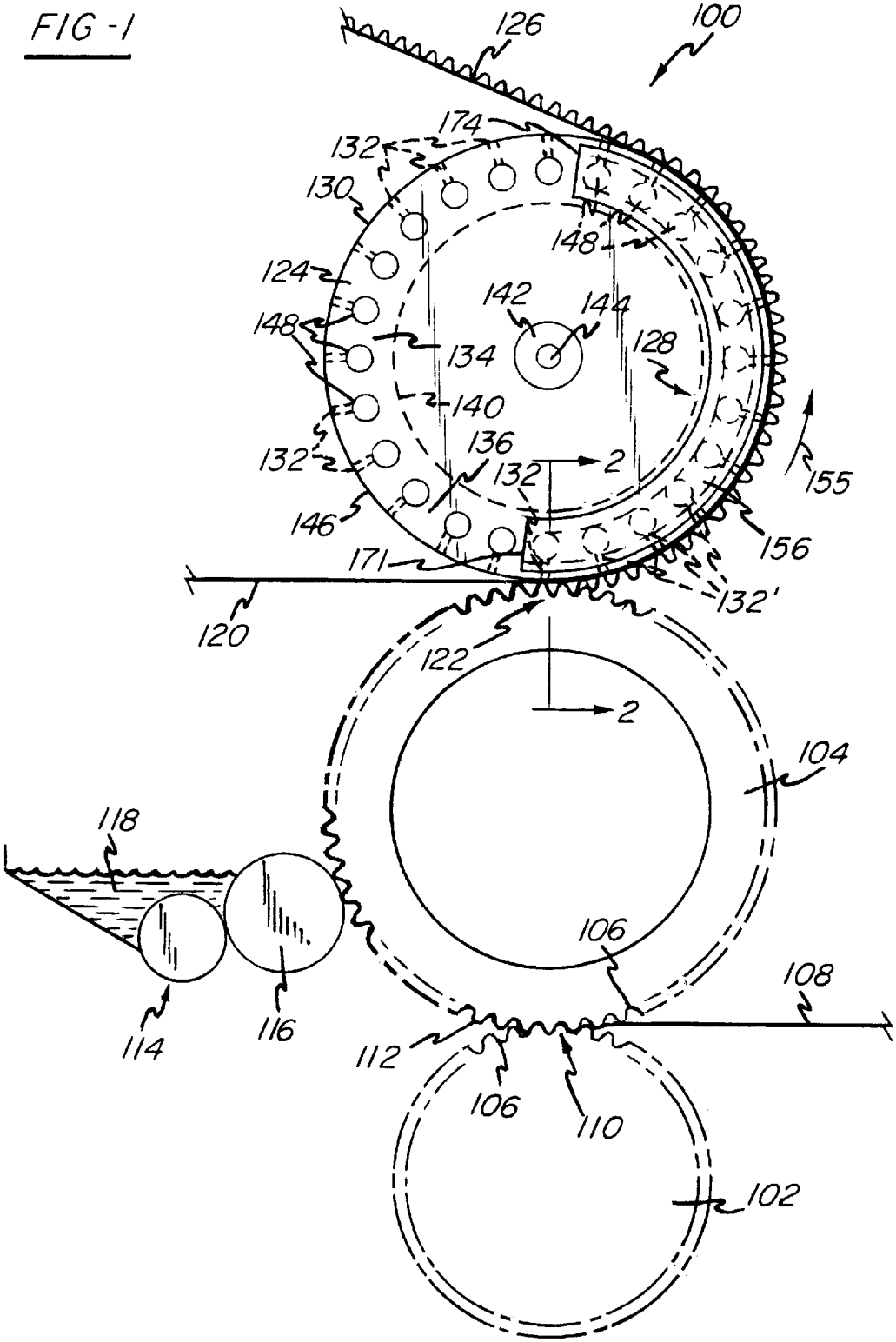
FIG. 1 is a side schematic view of a single facer of the present invention.
Figure 2:
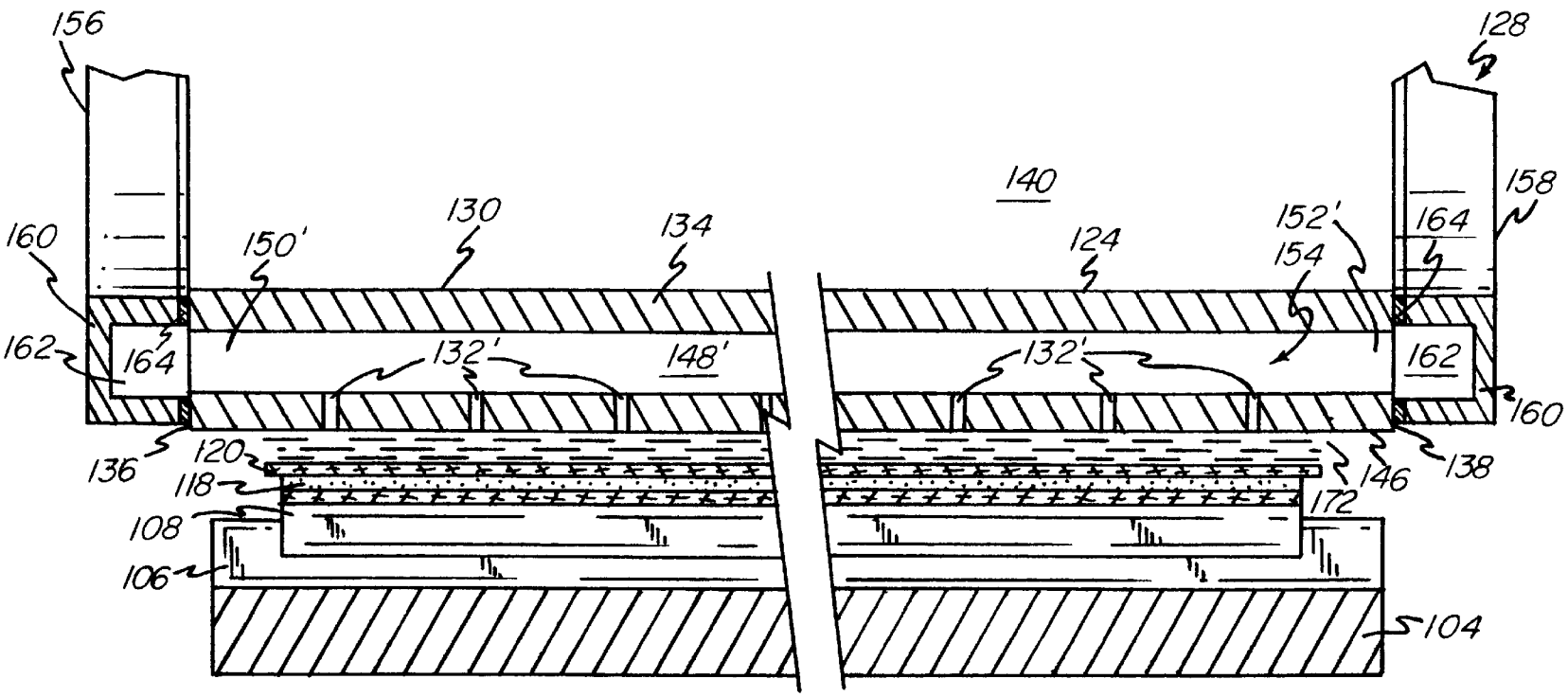
FIG. 2 is a cross-sectional view taken along line 2—2 of FIG. 1.

Referring initially to FIGS. 1 and 2, a single facer 100 of the present invention is shown as including a first, or forming, corrugating roll 102 operably connected to a second, or carrier, corrugating roll 104. Both corrugating rolls 102 and 104 include longitudinally extending teeth 106 formed on their respective circumferences. The corrugating rolls 102 and 104 are rotatably supported such that the teeth 106 of the carrier corrugating roll 104 are engagable with the teeth 106 of the forming corrugating roll 102 via a paperboard medium web 108.

The medium web 108 is supplied from a web feeding source (not shown), which is assumed to be on the right hand side of FIG. 1, to a corrugating nip 110 defined between the teeth 106 of the forming and carrier corrugating rolls 102 and 104 for forming predetermined flutes 112 within the medium web 108. A glue applicator 114 is disposed diagonally below the carrier corrugating roll 104. The glue applicator 114 is of conventional design and consists of a glue roll 116 rotatably supported to turn in a bath of glue 118 in response to rotation of the carrier corrugating roll 104. The medium web 108 is glued at its flutes 112 by the glue applicator 114 and then carried upwardly along the circumference of the carrier corrugating roll 104 into contact-with a liner web 120. The medium web 108 may be held against the carrier corrugating roll 104 through either positive air pressure or a vacuum in a manner well known in the art.

The liner web 120 is fed from a web feeding source (not shown), which is assumed to be on the left hand side of FIG. 1, to a bonding nip 122 defined between the carrier corrugating roll 104 and a pressing device in the form of a pressure roll 124. The bonding nip 122 presses the liner web 120 into adhering contact with the glued flutes 112 of the medium web 108, thereby forming a single face web 126. The pressure roll 124 is mounted for rotation such that the single face web 126 is conveyed upwardly along a circumference of the pressure roll 124 and then exits the single facer 100 for additional processing.

Figure 3:
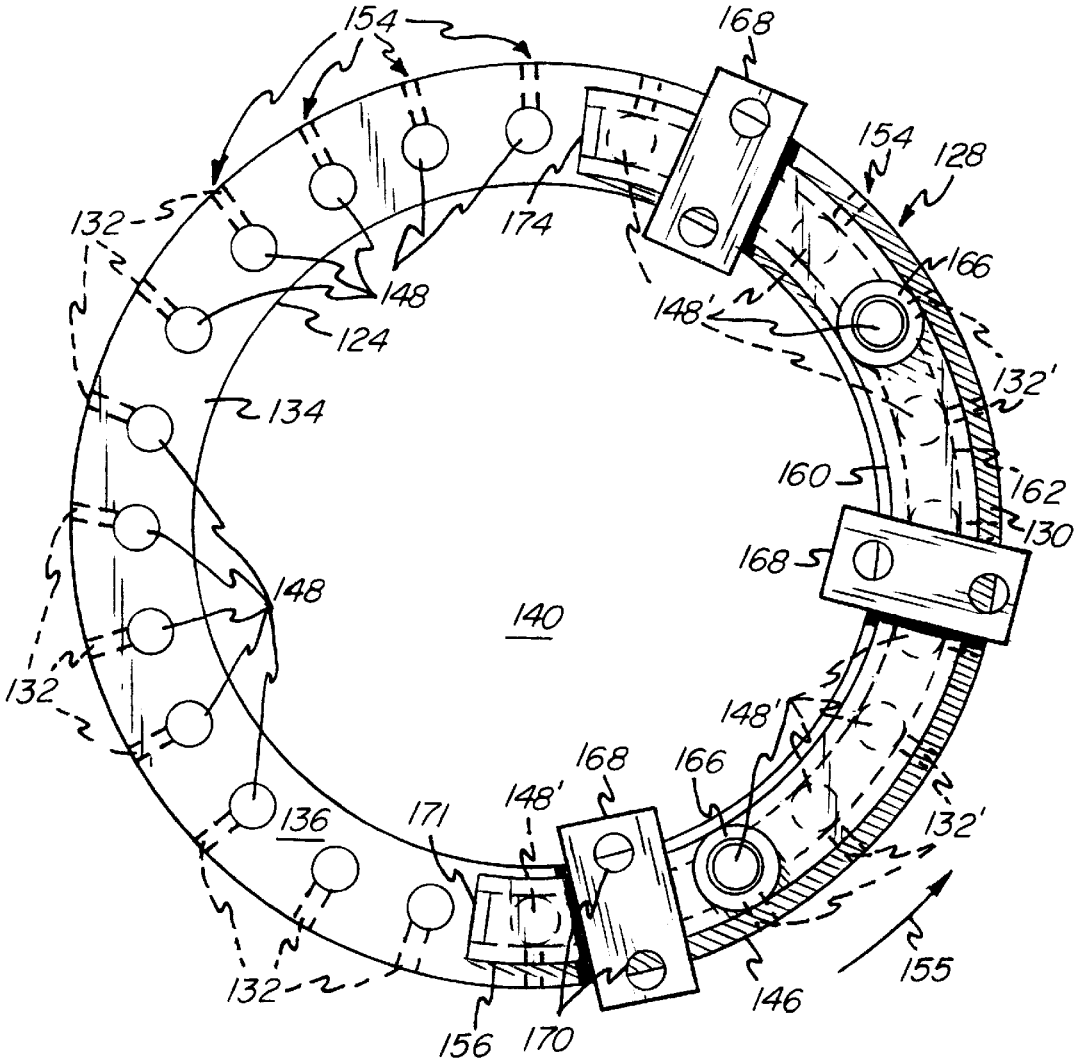
FIG. 3 is a side elevational view of the pressure roll shown in FIG. 1, with a portion of the end face removed to reveal the primary channel.

Referring to FIGS. 1–3, a steam supplying device 128 forms an integral part of the pressure roll 124 and includes a body 130 forming a plurality of radially extending fluid ports 132 in fluid communication with the bonding nip 122 for supplying a low pressure steam directly against the liner web 120. The body 130 includes a cylindrical wall 134 having planar end faces 136 and 138 (FIG. 2). An axially extending primary channel 140 is defined by the cylindrical wall 134 and is in fluid communication with a first, or high pressure, inlet port 142. The inlet port 142 is in fluid communication with an external high pressure steam source (not shown) and may be of conventional design. More particularly, a rotary steam joint of the type well known in the art may be utilized to define the high pressure steam inlet port 142 which is concentrically disposed around a high pressure steam condensate return port 144 (FIG. 1). Heat from the high pressure steam is conducted from the primary channel 140 through the cylindrical wall 134 to an outer peripheral surface 146 of the pressure roll 124. The cylindrical wall 134 is preferably comprised of carbon steel, although other known materials having suitable heat transfer quality may be substituted therefore.

A plurality of axially extending secondary channels 148 are disposed within the cylindrical wall 134 in substantially parallel relation to the primary channel 140. The secondary channels 148 are circumferentially spaced at equal distances from each other within the cylindrical wall 134. Each secondary channel 148 includes a second, or low pressure, inlet port 150 at end face 136 of the cylindrical wall 134. Each secondary channel 148 may also include an inlet port 152 at the second end face 138 of the cylindrical wall 134 to provide uniform steam distribution to the plurality of fluid ports 132 (FIG. 2). Alternatively, the secondary channels 148 may be sealed with plugs (not shown) proximate the second end face 138 of the pressure roll 124.

Referring further to FIGS. 2 and 3, the plurality of fluid ports 132 are arranged in axially, or laterally, extending rows 154 wherein the fluid ports 132 of each row 154 are equally spaced from each other and intersect a single secondary channel 148. Each row 154 of fluid ports 132 is circumferentially, or longitudinally, offset from each adjacent row 154 in a direction of travel of the paperboard webs 108 and 120, as indicated by arrow 155 in FIGS. 1 and 3. The fluid ports 132 extend circumferentially a full 360 degrees around the pressure roll 124. As is visible in FIG. 2, the plurality of fluid ports 132 provide communication between the secondary channels 148 and the heated outer surface 146 of the pressure roll 124.

Referring further to FIGS. 2 and 3, a pair of arcuate sealing members 156 and 158 slidably and sealingly engage the first and second end faces 136 and 138 of the pressure roll 124 for providing selective communication with a predetermined number of active inlet ports, designated by reference numerals 150' and 152', respectively. It should be noted that secondary channels and fluid ports supplied with low pressure steam will likewise be designated by reference numerals 148' and 132', respectively. The arcuate sealing members 156, 158 each include a housing 160 defining an arcuate passageway 162 for communicating with the inlet ports 150' and 152'. A seal 164 is mounted to the housing 160 for sealingly engaging each end face 136, 138 of the rotating cylindrical wall 134. The seal 164 is preferably made of teflon, however, other similar materials having suitable wear-resistance and sealing properties may be substituted therefore. It may be readily appreciated that as the pressure roll 124 rotates, the inlet ports 150, 152 will also rotate relative to the arcuate passageway 162 of the sealing members 156, 158 such that the active inlet ports 150', 152' will be continually changing.

Referring now to FIG. 3, the arcuate sealing members 156, 158 each include a pair of ports 166 communicating with the passageway 162. Both ports 166 are preferably connected to an external low pressure steam source (not shown) to provide an even steam distribution within the passageway 162. However, it may be appreciated that given external piping arrangements, only one of the two ports 166 may be supplied with low pressure steam, while the other port 166 may be sealed with an end plug (not shown).

A plurality of anchors 168 are fixed by welding or similar means to the housing 160 to facilitate mounting of the arcuate sealing members 156, 158 to a frame (not shown) of the single facer 100. A pair of mounting holes 170 are provided in each anchor 168 through which bolts may pass for securing the anchors and housing 162 the frame.

Next, the operation of the single facer 100 of FIGS. 1–3 will be described in greater detail. The medium web 108 is supplied to the corrugating nip 110 wherein the teeth 106 of the forming and carrier corrugating rolls 102 and 104 form flutes 112 within the medium web 108. The medium web 108 is next carried along the outer circumference of the carrier corrugating roll 104 to the glue applicator 114 where glue 118 is applied to the exposed flutes 112 of the medium web 108.

The carrier corrugating roll 104 then transports the medium web 108 to the bonding nip 122 formed between the rotating carrier corrugating roll 104 and the rotating pressure roll 124. The medium and liner webs 108 and 120 are brought together within the bonding nip 122 proximate the first end 171 of each arcuate sealing member 156 and 158. At the bonding nip 122, the liner web 120 is pressed into adhering contact with the glued flutes 112 of the medium web 108 for forming an initial bond between the webs 108 and 120.

High pressure steam is supplied to the primary channel 140 of the pressure roll 124 through the high pressure steam inlet port 142 from the external high pressure steam source. The high pressure steam heats the cylindrical wall 134 and the arcuate outer surface 146 such that contact between the liner web 120 and the outer surface 146 results in heat transfer to the glue between the webs 108 and 120. It should be noted that the high pressure steam is preferably saturated steam at a pressure of 185 pounds per square inch gravity (psig) at a temperature-of 375° F. While 185 psig is the optimum pressure for the high pressure steam supplied to the primary channel 140, the high pressure steam may possess a pressure within a wide range about 185 psig, but preferably between 150 psig and 200 psig.

Low pressure steam at approximately 0.6 psig is supplied to the ports 166 of the arcuate sealing members 156 and 158 by the low pressure steam source. While 0.6 psig is the optimum pressure for the low pressure steam, it is envisioned that such pressure may be within a range between 0.5 psig and 10 psig. It is believed that 0.5 psig is the minimum pressure required for the low pressure steam to adequately penetrate the porous paperboard webs 108 and 120 and contact the glue 118. It is further believed that 10 psig is the maximum pressure which may be applied to the bonding nip 122 without severely damaging the paperboard webs 108 and 120. The low pressure steam travels through the passageway 162 of the housing 160 through the active inlet ports 150' and 152' of the active secondary channels 148'. The low pressure steam is then released through the outlet fluid ports 132' to form a thin steam film 172 between the liner web 120 and the outer surface 146 of the pressure roll 124. The steam exiting the fluid ports 132 passes through the liner web 120 to the glue 118 between the medium and liner webs 108 and 120. The newly formed single face web 126 diverges from the pressure roll 124 proximate a second end 174 of each arcuate sealing member 156 and 158.

From extensive experimentation it has been unexpectedly discovered that the low pressure steam film 172 significantly accelerates the gelatinization of the glue 118 between the paperboard web 108 and 120. This method and apparatus dramatically increases the heat transfer to the glue 118 as compared to the prior art method and apparatus, which relies on the inherently poor thermal conduction between a heated surface and the paperboard webs 108 and 120. The rapid glue gelatinization improves the initial bond formed between the medium web 108 and the liner web 120, thereby permitting the formation of an adequate bond with less pressure applied at the bonding nip 122. Further, the processing speed of the corrugating equipment may be increased as the paperboard does not require long heat transfer periods of time. Additionally, the steam film 172 facilitates the processing of multi-walled paperboard webs.

It is believed that the significant benefits resulting from the use of the low pressure steam at the bonding nip 122 result from a mass transfer process including the absorption and condensation of steam in the paperboard webs 108 and 120 and, in particular, on the glue 118 between the webs 108 and 120. A large quantity of thermal energy is released upon the condensation of steam giving rise to the observed improvements in the gelatinization of the glue 118 between webs 108 and 120.

In the following description of alternative embodiments of the present invention, it is to be understood that like reference numerals refer to like components. Additionally, the formation of flutes 112 in the medium web 108 is identical to that disclosed with respect to the embodiment of FIG. 1. However, it should be understood that the precise method or apparatus for flute 112 formation in no way limits the scope of the present invention and that other methods and forms of apparatus for such formation may be readily substituted therefore.

Figure 4:
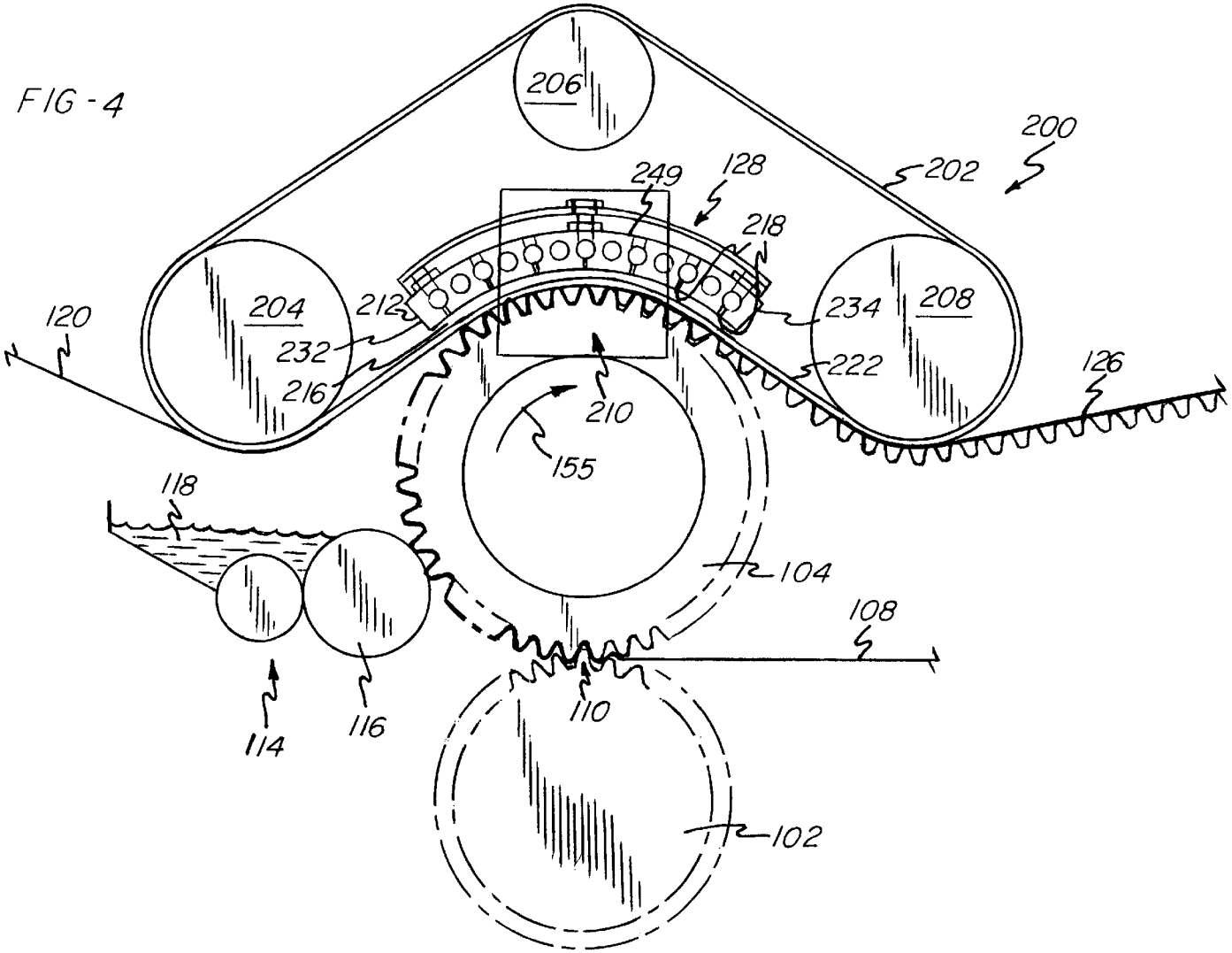
FIG. 4 is a side schematic view of a further embodiment of the single facer of the present invention.

Turning now to FIG. 4, an alternative embodiment of the single facer 200 of the present invention is illustrated. The pressing device comprises a pressure belt 202 is wrapped around a plurality of rotatably mounted belt rolls 204, 206, 208 for guiding the belt 202 in motion. The pressure belt 202 cooperates with the carrier corrugating roll 104 to form an extended bonding nip 210 for pressing the liner web 120 into adhering contact with the glued flute tips 112 of the medium web 108.

The steam supplying device 128 as illustrated in FIG. 4 comprises a shoe 212 mounted within the inner run of the belt 202. The shoe 212 includes an arcuate heated surface 216 extending circumferentially from a first side edge 232 proximate a point of initial contact between the webs 108 and 120 to a second side edge 234 proximate a point of divergence of the single face web 126 from the carrier corrugating roll 104. The heated surface 216 includes a plurality of fluid ports 218 in communication with the bonding nip 210 and facing the inner surface 222 of the belt 202 and the teeth 106 of the carrier corrugating 104.

Figure 5:
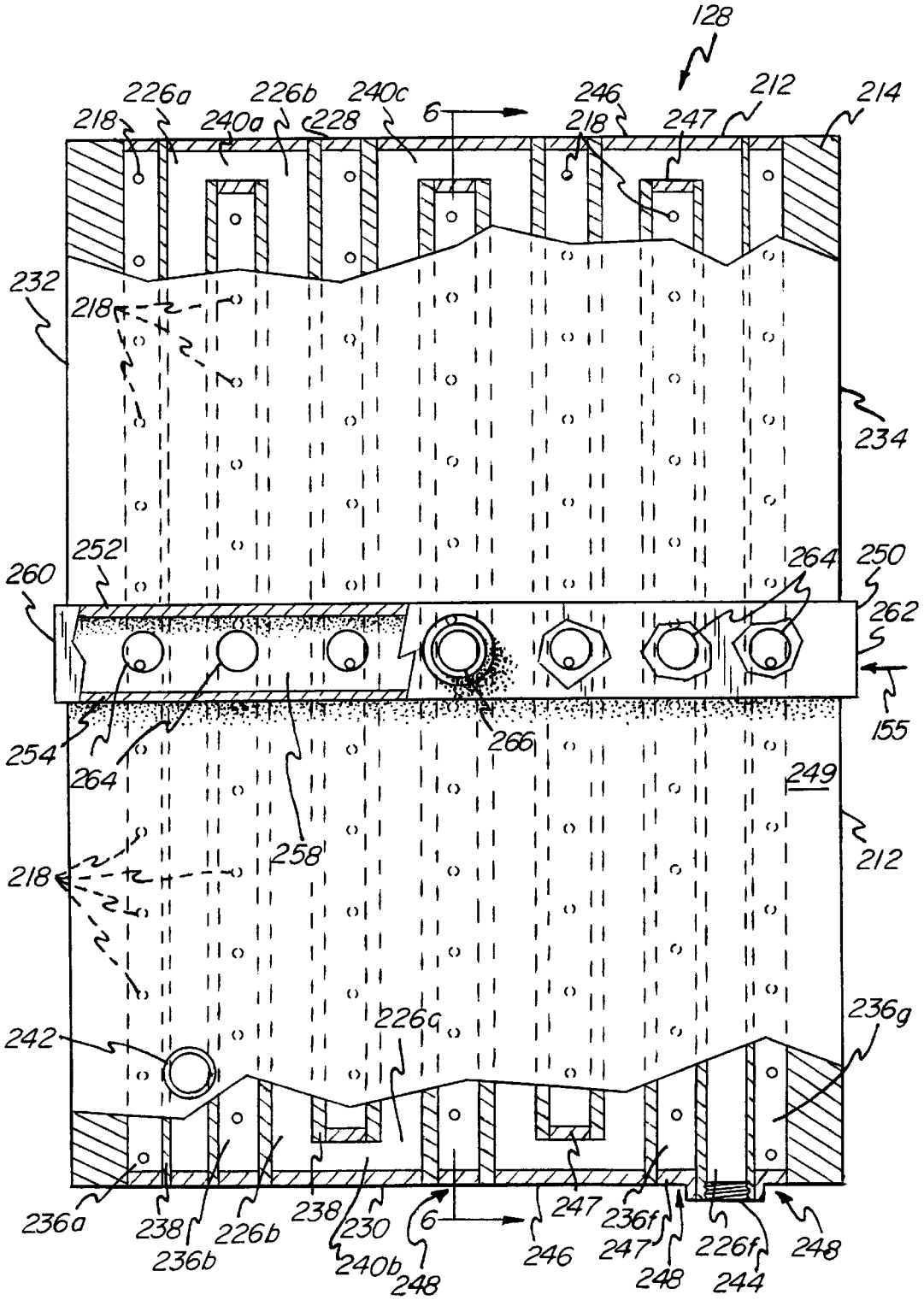
FIG. 5 is a top plan view of the shoe of FIG. 4, where the shoe is partially broken away to show the internal structure.
Figure 6:
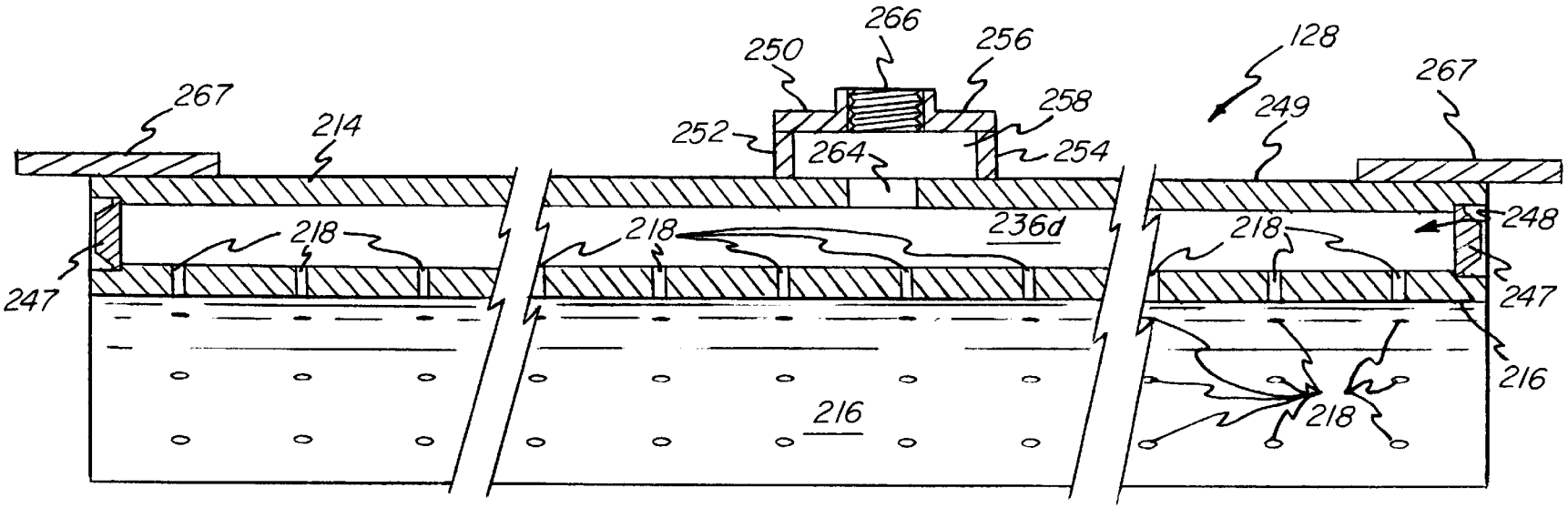
FIG. 6 is a cross-sectional view taken along the line 6—6 of FIG. 5.
Figure 7:
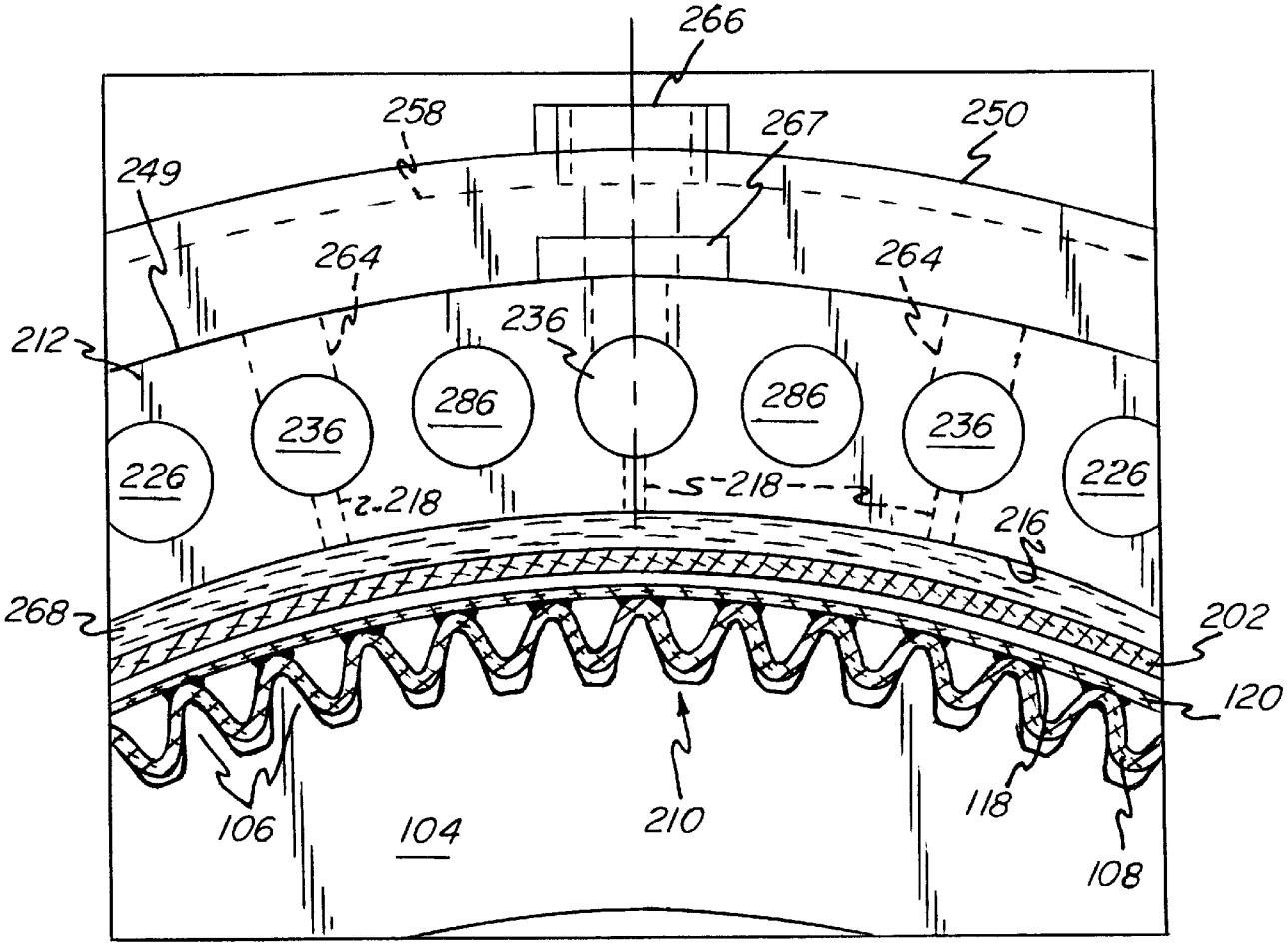
FIG. 7 is a detail view of FIG. 4.

With reference now to FIGS. 5–7, the shoe 212 will be described in greater detail. The shoe 212 is defined by a body 214 defining the arcuate heated surface 216 and a plurality of fluid ports 218. The body 214 is preferably comprised of a carbon steel, although other known materials having suitable heat transfer qualities are also possible. It should be noted that the shoe 212 is arcuately formed by rolling the body 214 into the requisite curvature. The body 214 forms a plurality of primary channels 226 extending between opposite end faces 228 and 230 in a direction substantially perpendicular to the direction of web movement 155 and parallel to side edges 232 and 234.

A plurality of secondary channels 236 extend in substantially parallel relation to the primary channels between opposite end faces 228 and 230 of the shoe 212. It should be noted that the channels 226 and 236 are preferably cylindrical in nature and formed by drilling through the body 214 from one end 228, 230 to the other end 230, 228, thereby defining walls 238 between adjacent channels.

Adjacent primary channels 226 are interconnected proximate alternating end faces 228, 230 of the shoe 212 to form a continuous serpentine path therethrough. In order to interconnect adjacent channels, slots 240 are provided at the end faces 228, 230. While the primary channels, secondary channels, walls and slots are referred to generally by reference numerals 226, 236, 238 and 240 respectively, a particular item will be referred to by the reference numeral in combination with a lower case letter, as more clearly shown in FIGS. 6 and 7.

Referring further to FIG. 5, slot **240*a* is included at end 228 of the body 214 to interconnect the first two primary channels 226*a* and 226*b*. At the opposite end 230, slot 240*b* interconnects the second and third primary channels 226*b* and 226*c*. Each pair of adjacent primary channels 226 are interconnected at alternate ends to form a serpentine path through the body 214**.

With further reference to FIGS. 5 and 6, the body 214 further includes a first, or high pressure, steam inlet port 242 preferably located proximate the end face 230 and side 232 for intersecting the primary channel **226*a* opposite the slot 240*a* interconnecting the primary channel 226*a* with primary channel 226*b*. The high pressure steam inlet port 242** is connected to an external high pressure steam source (not shown) for supplying a second, or high pressure, steam to the serpentine path formed by the primary channels 226. The body 214 further includes a first, or high pressure, condensate return port 244 communicating with primary channel 226*f* proximate side 234 and extending through end 230. As may be appreciated, high pressure steam applied through inlet port 242 travels through the serpentine path defined by the primary channels 226 and exits through return port 244.

In the preferred embodiment of the invention, the slots 240 are formed by milling a portion of the walls 238 between two adjacent primary channels 226 at the appropriate ends 228, 230. To seal the interconnection between the alternate primary channels 226, end plugs or plates 246 are placed within the slots 240, only partially filling the void created by the slots 240, and are preferably welded to the end faces 228, 230 of the body 214. End plugs or plates 247 are similarly welded to the body 214 for sealing opposing ends of the secondary channels 236. Each secondary channel 236 is sealed from the other channels 226 and 236 within the body 214.

The plurality of secondary channels 236 extend parallel to the primary channels 226 between end faces 228 and 230, and are preferably located intermediate adjacent primary channels 226. The secondary channels 236 extend laterally or perpendicular to the direction of travel 155 of the paperboard webs 108, 120, and are circumferentially, or longitudinally, offset from the primary channels 226. Each secondary channel 236 intersects a plurality of the fluid ports 218 thereby forming a laterally extending row 248 of fluid ports 218. As may be readily seen in FIG. 5, the rows 248 of fluid ports are longitudinally spaced in the direction of web travel 155.

As may be seen in FIGS. 4–6, the channels 226 and 236 may be substantially equally spaced between an upper surface 249 of the body 214 and the lower arcuate heated surface 216. Alternatively, the secondary channels 236 may be positioned closer to either surface 216 and 249 than the adjacent primary channels 226. For example, if the primary channels 226 are positioned closer to the heated surface 216 than the secondary channels 236, it may be appreciated that the primary channels 226 may be spaced closer to each other thereby increasing the number of primary channels 226 within the body. Of course, the larger the number of primary channels 226, the greater the potential for heat transfer to the heated surface 216 of the shoe 212. Therefore, the particular placement of the primary and secondary channels 226 and 236 relative to each other may be varied greatly depending upon operating conditions and properties of the paperboard webs 108 and 120 and glue 118.

Referring further to FIGS. 4–6, the shoe 212 further includes an arcuate manifold 250 centrally located between end faces 228 and 230 and fixed to the upper surface 249 of the body 214. The manifold 250 includes arcuate side plate 252 and 254 secured to an arcuate top plate 256 for defining an internal passageway 258. The ends of the passageway 258 are sealed by end plates 260 and 262. As illustrated in FIG. 5, a plurality of ports 264 are provided through the upper surface 249 of the body 214 for providing communication between each secondary channel 236 and the passageway 258 defined by the manifold 250. An inlet port 266 is provided within the arcuate top plate 256 of the manifold 250 for providing fluid communication between the passageway 258 and an external low pressure steam source (not shown). The inlet port 266 is preferably centrally positioned between end plates 260 and 262. Low pressure steam supplied to the inlet port 266 is distributed through ports 264 to the plurality of secondary channels 236 and is then released through a plurality of fluid ports 218 into the bonding nip 210 for acting upon the paperboard webs 108 and 120 therein.

The low pressure steam supplied to the secondary channels 236 is preferably superheated by heat transfer from the primary channels 226. Additionally the belt 202 comprises a porous material such that the steam exiting the fluid ports 218 passes through the belt 202 and into direct contact with the liner web 120. As described above with reference to the embodiment of FIG. 1, the injection of steam against the glue 118 between the medium web and the liner facilitates rapid glue gelatinization and bond formation. To facilitate mounting within the single facer 200, the shoe 212 may include a plurality of mounting plates 267 fixed to the body 214.

In operation, the medium web 108 is supplied to the corrugating nip 110 and glue 118 is applied to its exposed flutes 112 in the manner described above with reference to FIG. 1. The medium and liner webs 108 and 120 are then supplied to the bonding nip 210 defined by the pressure belt 202 and carrier corrugating roll 104 such that the webs 108 and 120 are pressed together in adhering contact.

Simultaneously, high pressure steam is supplied to the high pressure steam inlet port 242 for supplying the primary channels 226 with high pressure steam for heating the arcuate heated surface 216 of the shoe 212. Turning now to FIG. 7, low pressure steam is supplied to the manifold 250 through inlet port 266 from a low pressure steam source. The low pressure steam passes through ports 264 into the plurality of independently sealed secondary channels 236. The low pressure steam exits through the plurality of fluid ports 218 into the bonding nip 210 for forming a thin steam film 268 between the arcuate heated surface 216 and the belt 202 which lubricates the surface 216 from frictional contact. The low pressure steam passes through the porous pressure belt 202 and contacts the liner web 120. Given the porosity of paperboard, a portion of the steam passes through the liner web 120 and condenses proximate the glue 118 defined between the liner and medium webs 120 and 108. As described above with respect to the FIG. 1 embodiment, upon condensation, the steam releases a large amount of thermal energy which facilitates rapid gelatinization of the glue and formation of a final bond between the webs 108 and 120.

Figure 8:
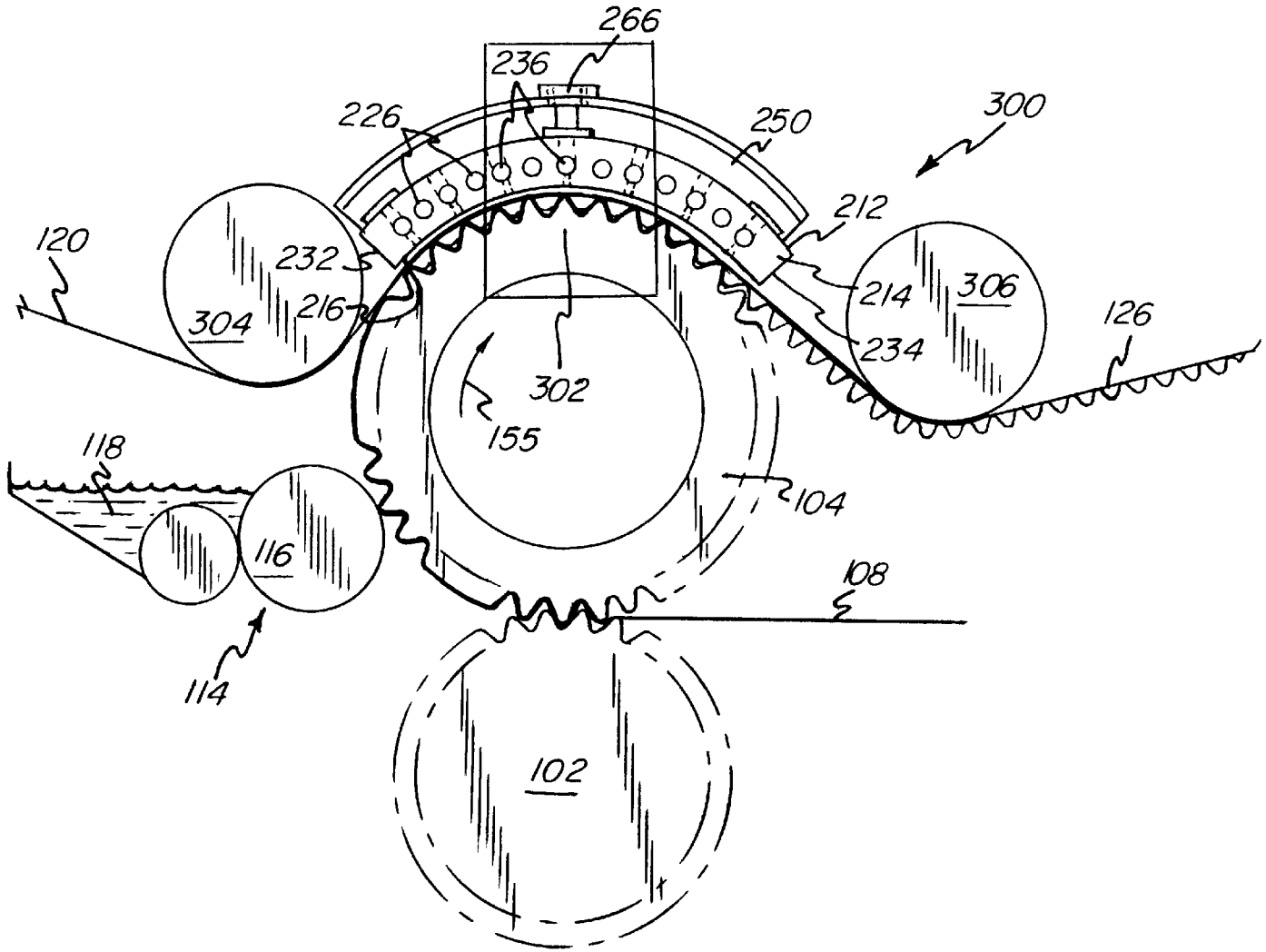
FIG. 8 is a side schematic view of a further embodiment of the single facer of the present invention.
Figure 9:
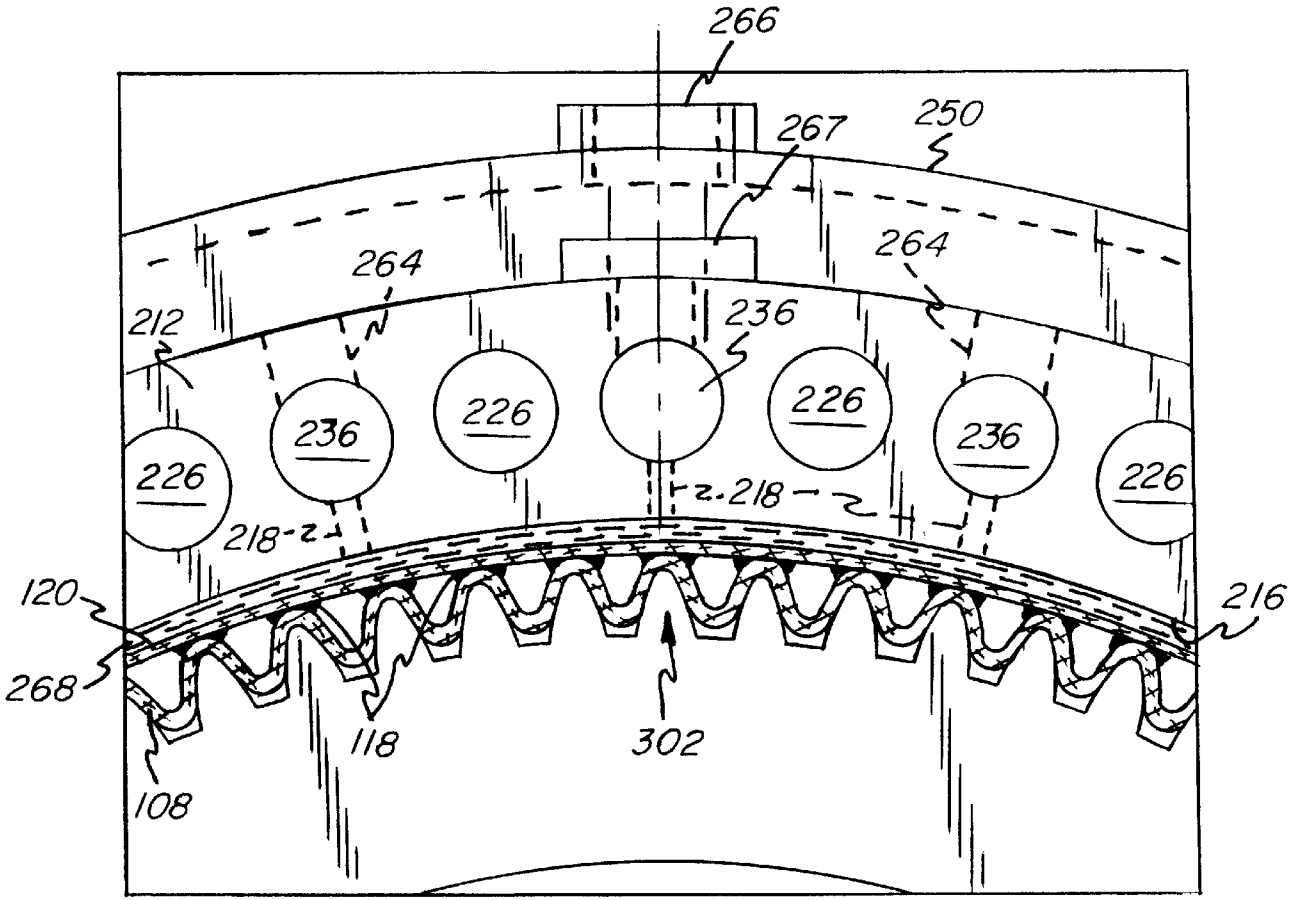
FIG. 9 is a detail view of FIG. 8.

Turning now to FIGS. 8 and 9, a further embodiment of the single facer 300 of the present invention is illustrated. The single facer 300 is similar to that disclosed in FIGS. 4–7, the major difference being the removal of the pressure belt 202 cooperating with the carrier corrugating roll 104. A bonding nip 302 is instead formed by the arcuate heated surface 216 of the shoe 212 cooperating with the carrier corrugating roll 104. In other words, the shoe 212 itself forms the pressing device. The shoe 212 may be resiliently mounted for applying an adjustable pressure within the pressure nip 302. More particularly, the shoe 212 may be spring biased for pressing the liner web 120 into adhering contact with the glued flutes 112 of the medium web 108.

The liner web 120 is guided through the pressure nip 302 by a pair of idler guiding rolls 304 and 306 positioned in spaced relation to each other proximate opposite sides of the carrier corrugating roll 104. Guiding roll 304 guides the liner web 120 into initial contact with the medium web 108 at a point proximate the first side edge 232 of the shoe 212. Guiding roll 306 guides the newly formed single face web 124 away from the single facer 300 such that the single face web 124 diverges from the carrier corrugating roll 104 proximate the second side edge 234 of the shoe 212. Either one of the idler rolls 304 and 306 may be configured to cooperate with the carrier corrugating roll 104 to form an auxiliary nip for pressing the liner web 120 and the medium web 108 against the carrier corrugating roll 104.

The remaining structure of the shoe 212 is substantially identical to that described above with respect to the embodiment of FIGS. 4–7.

In operation the idler guiding rolls 304 and 306 guide the liner web 120 around a portion of the circumference of the carrier corrugating roll 104 while the shoe 212 presses the liner web 120 into adhering contact with the medium web 108. A high pressure steam is supplied to the primary channels 226 and low pressure steam is supplied to secondary channels 236 in the manner described above with respect to the embodiment of FIGS. 4–7. The low pressure steam exits through the plurality of the fluid ports 218 to form a thin steam film 268 between the liner web 120 and the arcuate heated surface 216. The steam film 218 lubricates the surface 216 to prevent frictional contact between the moving liner web 120 and surface 216. A portion of the steam passes through the porous liner web 120 to the glue 118 between the medium web 108 and liner web 120 where it transfers heat for facilitating gelatinization of the glue 118.

Figure 10:
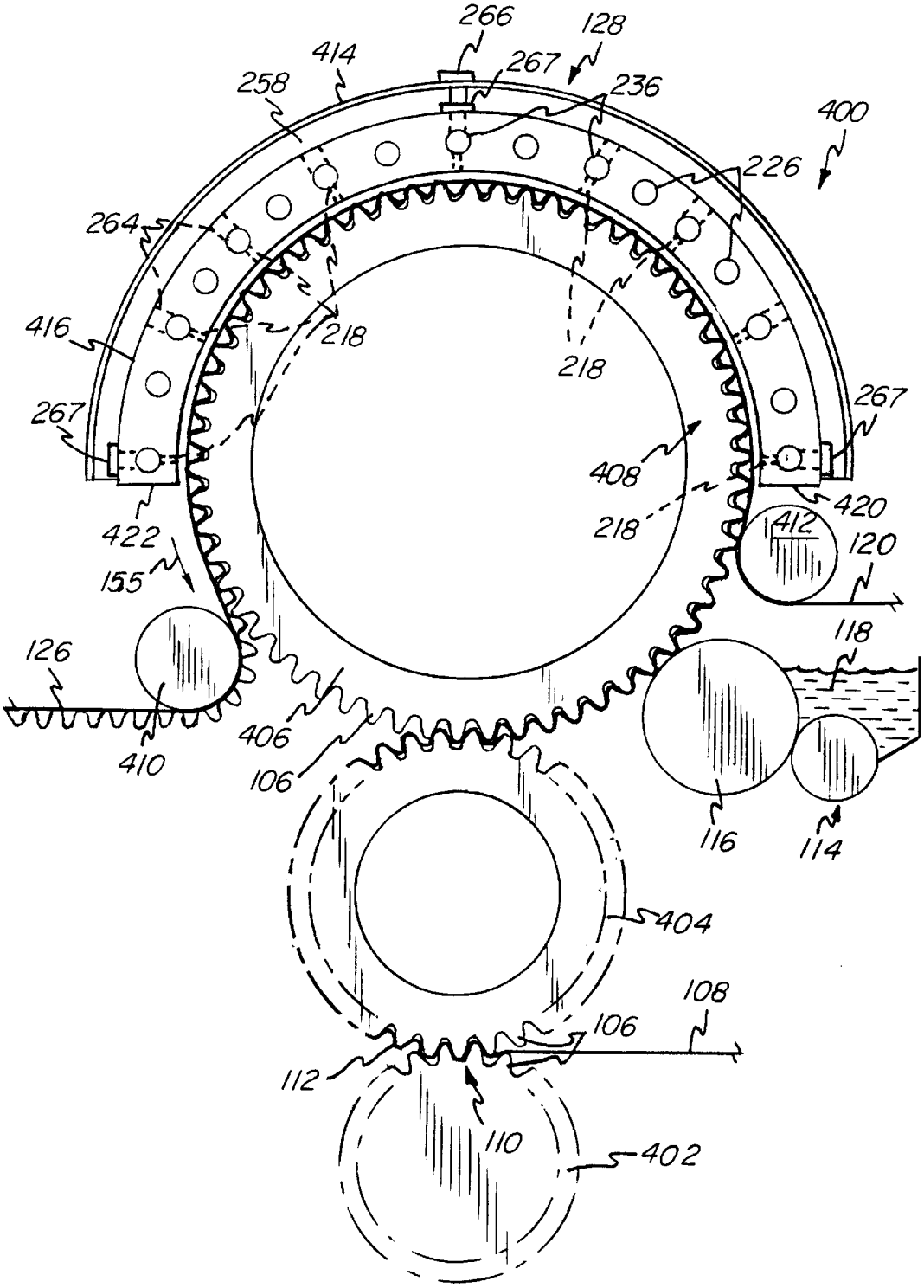
FIG. 10 is a side schematic view of a further embodiment of the single facer of the present invention.

Turning now to FIG. 10, an alternative embodiment of the single facer 400 of the present invention includes three corrugating rolls 402, 404 and 406 operably connected for combined rotation. A corrugating nip 110 is defined between the small diameter forming corrugating roll 402 and the small diameter intermediate corrugating roll 404 for forming flutes 112 within the medium web 108. Both corrugating rolls 402 and 404 have small outer diameters of approximately 16 inches each. As with the previous embodiments, the corrugating rolls 402, 404 and 406 all have a plurality of laterally extending teeth 106 which mesh with an adjacent corrugating roll 402, 404 and 406. The medium web 108 is held on the intermediate corrugating roll 404 until it meshes with the large diameter carrier corrugating roll 406. The medium web 108 is then transferred to the carrier corrugating roll 406 where glue 118 is applied to its exposed flute tips 112. The carrier corrugating roll 406 then transports the medium web 108 into adhering contact with the liner web 120 at an extended bonding nip 408.

The bonding nip 408 is formed by the liner web 120 which is tightly drawn over the large corrugating roll 406 by being partially wrapped around a pair of rotatably mounted guiding idler rolls 410 and 412. In other words, the liner web 120 cooperating with the rolls 410 and 412 define the pressing device. As illustrated in FIG. 10, the extended bonding nip 408 provided by this arrangement facilitates extended pressing duration for finalizing the bond between the medium and liner webs 108 and 120. The bonding nip 498 extends circumferentially around the large diameter carrier corrugating roll 406 in an arc of approximately 180°. The carrier corrugating roll has a large outer diameter of approximately 48 inches for providing a longer bonding nip 408 than would be provided by a liner web 120 similarly wrapped around a smaller outer diameter carrier corrugating roll. It should be further noted that in order to avoid high paper tensions during the corrugation process, it is necessary that the flutes 112 be formed by the small diameter forming corrugating roll 402, rather than by the large carrier corrugating roll 406 cooperating with a corrugating roll having a substantially equivalent large outer diameter. It may be appreciated that the corrugating nip 110 could be defined between corrugating rolls 404 and 406 such that corrugating roll 402 is eliminated.

A steam supplying device 128 comprising a shoe 414 is provided immediately adjacent the bonding nip 408. The shoe 414 includes a body 416 having an arcuate heated surface 418 circumferentially extending substantially the full distance of the bonding nip 408. More particularly, the body has a first side edge 420 proximate a point of initial contact between the liner and medium webs 120 and 108 and a second side edge 422 proximate a point of divergence from the newly formed single faced web 126 from the carrier corrugating roll 406.

Since the bonding nip 408 of the single facer 400 of FIG. 10 has a circumferential distance greater than that of the bonding nip 302 as illustrated in FIG. 8, the shoe 212 of the embodiment of FIGS. 4–7 has been circumferentially extended to form an arc of approximately 180° thereby defining shoe 414 of FIG. 10. The remaining details of shoe 414 are substantially identical to those as disclosed above with respect to shoe 212 of FIGS. 4–7.

It may be appreciated that the single arcuate shoe 414 could be substituted with a plurality of individual arcuate shoes which collectively define the arcuate heated surface 418 and plurality of fluid ports 218. With such an arrangement, each individual arcuate shoe could be resiliently mounted, or spring biased, so that the shoes could provide additional pressure acting against the medium and liner webs 108 and 120 for facilitating bonding therebetween.

Figure 11:
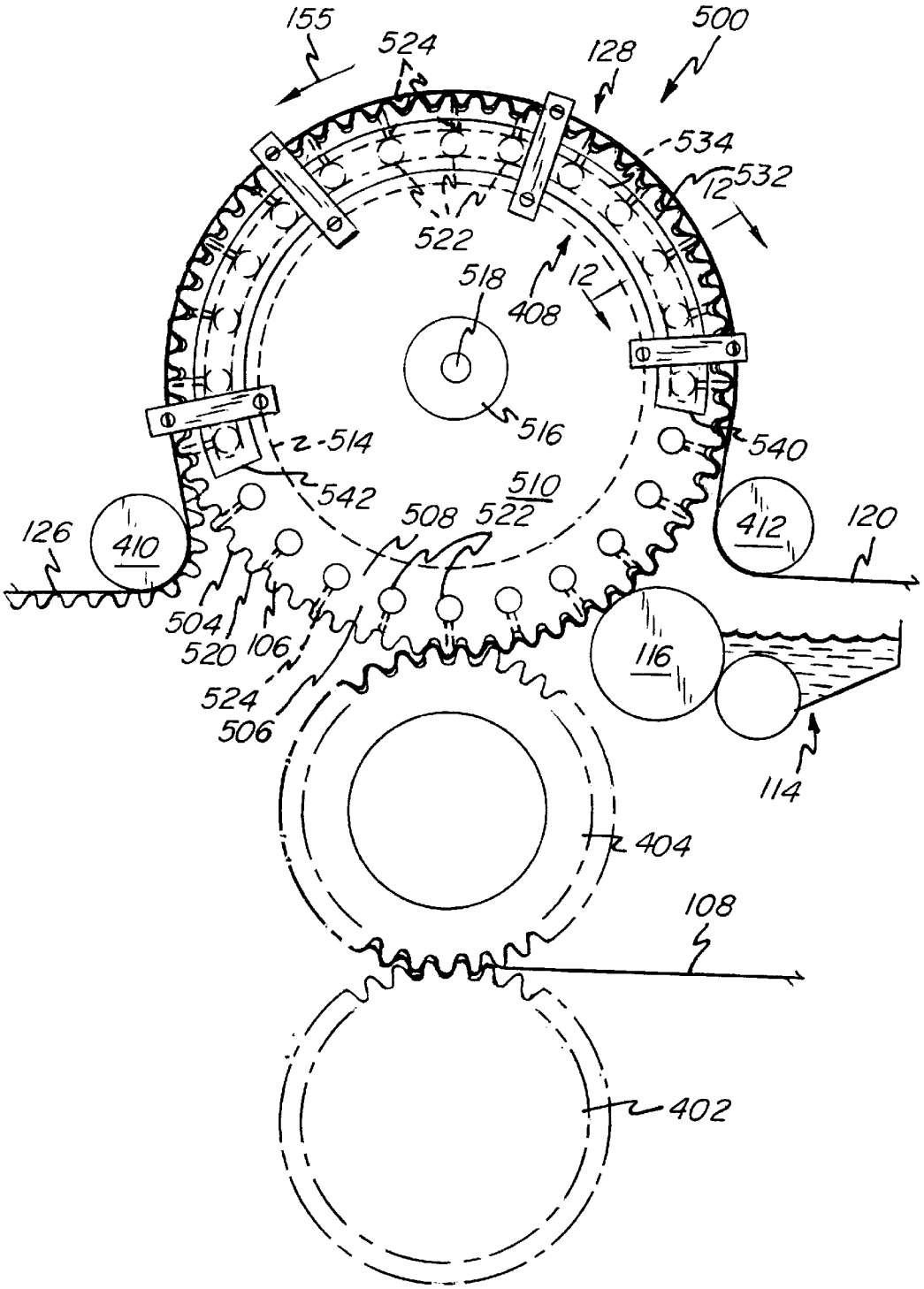
FIG. 11 is a side schematic view of a further embodiment of the single facer of the present invention.
Figure 12:
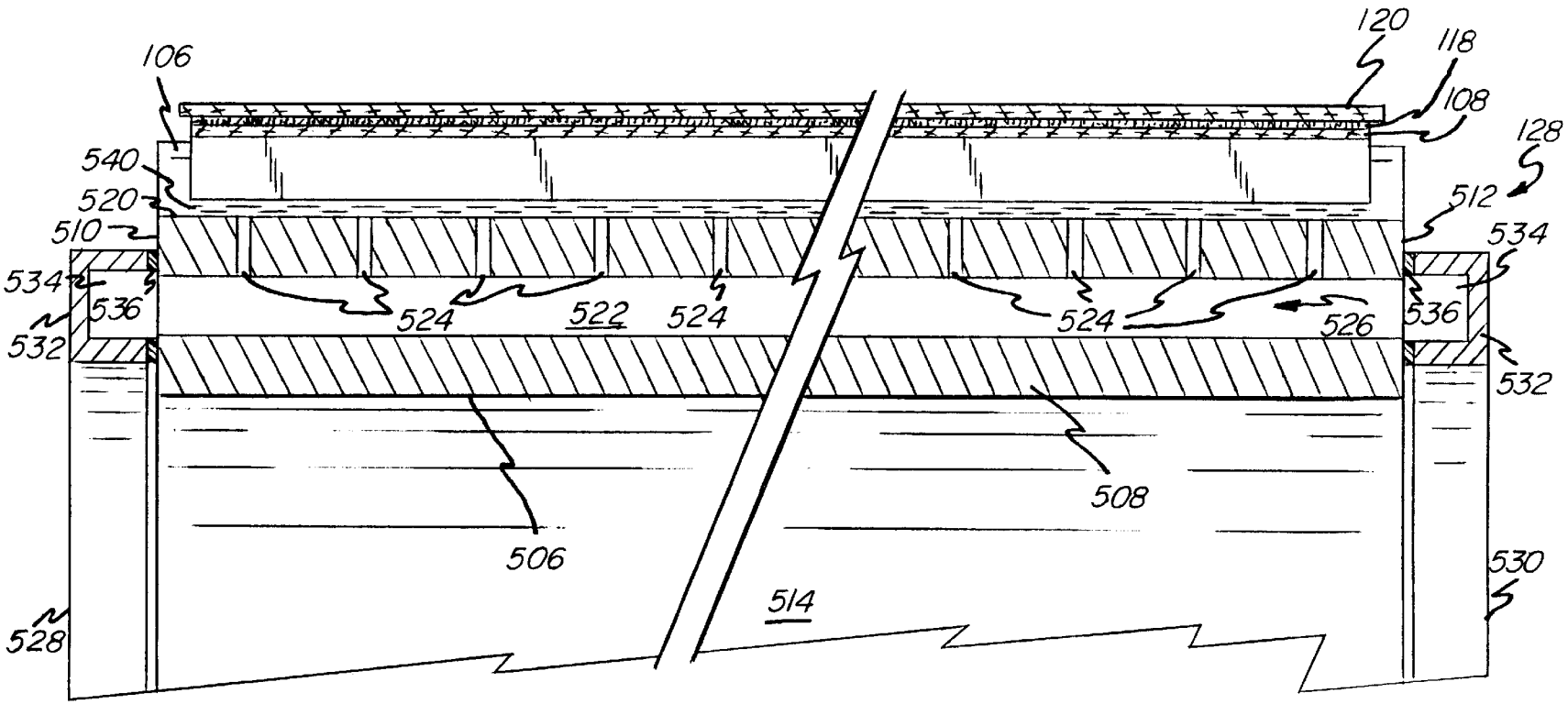
FIG. 12 is a cross-sectional view taken along line 12—12 in FIG. 11.
Figure 13:
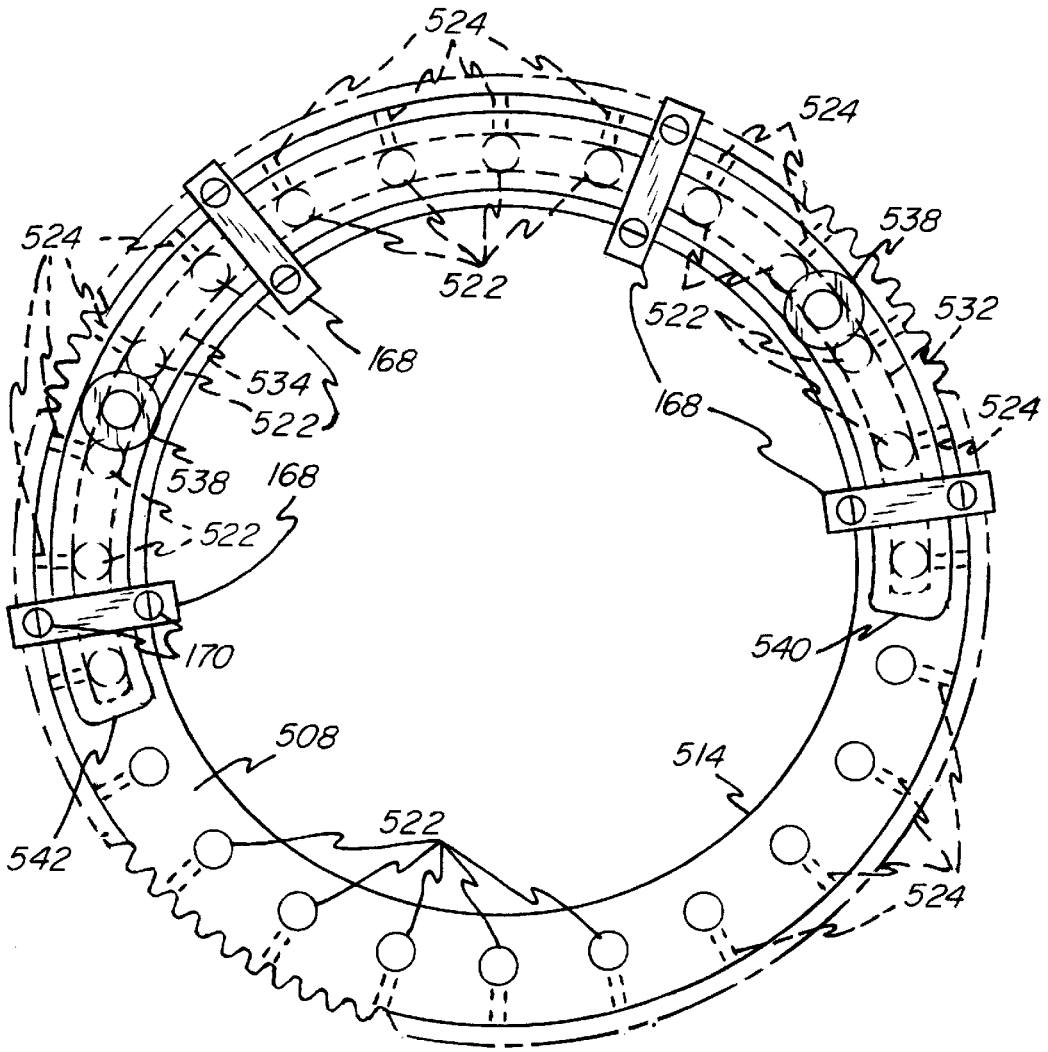
FIG. 13 is a side elevational view of the carrier corrugating roll shown in FIG. 11, with a portion of the end face removed to reveal the primary channel.

Turning now to FIGS. 11 and 12, the single facer 500 is a variation of single facer 400 as disclosed in FIG. 10. However, the steam supplying device of FIG. 11 forms an integral part of a carrier corrugating roll 504. More particularly, the steam supplying device 128 comprises a body 506 having a cylindrical wall 508 extending between end faces 510 and 512. The cylindrical wall 508 forms a primary channel 514 extending between end faces 510 and 512. A first, or high pressure, steam inlet port 516 is provided at one of the end faces 510 and 512 of the cylindrical wall 508 for supplying high pressure steam to the primary channel 514. A first, or high pressure, steam condensate return port 518 is concentrically disposed within the inlet port 516. The ports 516 and 518 may be defined by a conventional rotary steam joint as described above with respect to the embodiment of FIG. 1. High pressure steam supplied to the primary channel 514 conducts thermal energy to the cylindrical wall 508, thereby heating an outer surface 520 of the carrier corrugating roll 504 as defined by the teeth 106.

A plurality of axially extending secondary channels 522 are formed within the cylindrical wall 508 in substantially parallel relationship to each other and to the primary channel 514. Each secondary channel 522 is in fluid communication with a plurality of fluid ports 524 arranged in laterally extending rows 526, i.e. perpendicular to the direction of web travel 155. The rows 526 of fluid ports 524 are circumferentially, or longitudinally, offset in the direction of web travel 155 in equally spaced relationship around the entire perimeter of the carrier corrugating roll 504.

A pair of arcuate sealing members 528 and 530 sealingly and slidably engage the opposing end faces 510 and 512 of the cylindrical wall 508. More particularly, each arcuate sealing member 510 and 512 includes an arcuate housing 532 defining an arcuate passageway 534. A seal 536, preferably teflon, sealingly and slidably engages one of the end faces 510 and 512 of the cylindrical wall 508. A pair of inlet ports 538 are provided within the housing 532 for connection to an external low pressure steam source (not shown) for providing low pressure steam to the internal passageway 534. The number and location of inlet ports 538 may be varied depending upon the arrangement necessary for connecting to external steam piping. The remaining details of the arcuate sealing members 528 and 530 are substantially identical to those described above with respect to arcuate sealing members 156 and 158 of FIGS. 1–3.

In operation, the flute tips 112 of the medium web 108 are brought into contact with the liner web 120 proximate a first end 540 of each arcuate sealing member 528 and 530. The liner web 120 is wrapped around the pair of idler rolls 410 and 412 disposed on opposite sides of the carrier corrugating roll 504 such that the liner web 120 is in tension. Tension within the liner web 120 forces the liner web 120 against the carrier corrugating roll 504 such that the medium web 108 and liner web 120 are pressed together in adhering contact. Simultaneously, high pressure steam is supplied from an external source to the primary channel 514 for heating the outer surface 520 of the carrier corrugating roll 504 through the cylindrical wall 508. Heat is thereafter transferred from the arcuate outer surface 520 of the carrier corrugating roll 504 to the medium web 108.

Low pressure steam is supplied to the internal passageways 534 of the arcuate sealing members 528 and 530 through one or more of the inlet ports 538. The low pressure steam travels through the plurality of secondary channels 522 and is released through the plurality of fluid ports 524 against the medium web 108 within the bonding nip 408. A thin steam film 540 is produced between the medium web 108 and the outer surface 520 of the carrier corrugating roll 504. A portion of the low pressure steam passes through the relatively porous paperboard medium web 108 to the glue 118 between the medium and liner webs 108 and 120. As detailed above, the steam releases thermal energy to the glue to assist in its rapid gelatinization. The newly formed single face web 126 diverges from the carrier corrugating roll 504 proximate the second end 542 of the arcuate sealing member.

Figure 14:
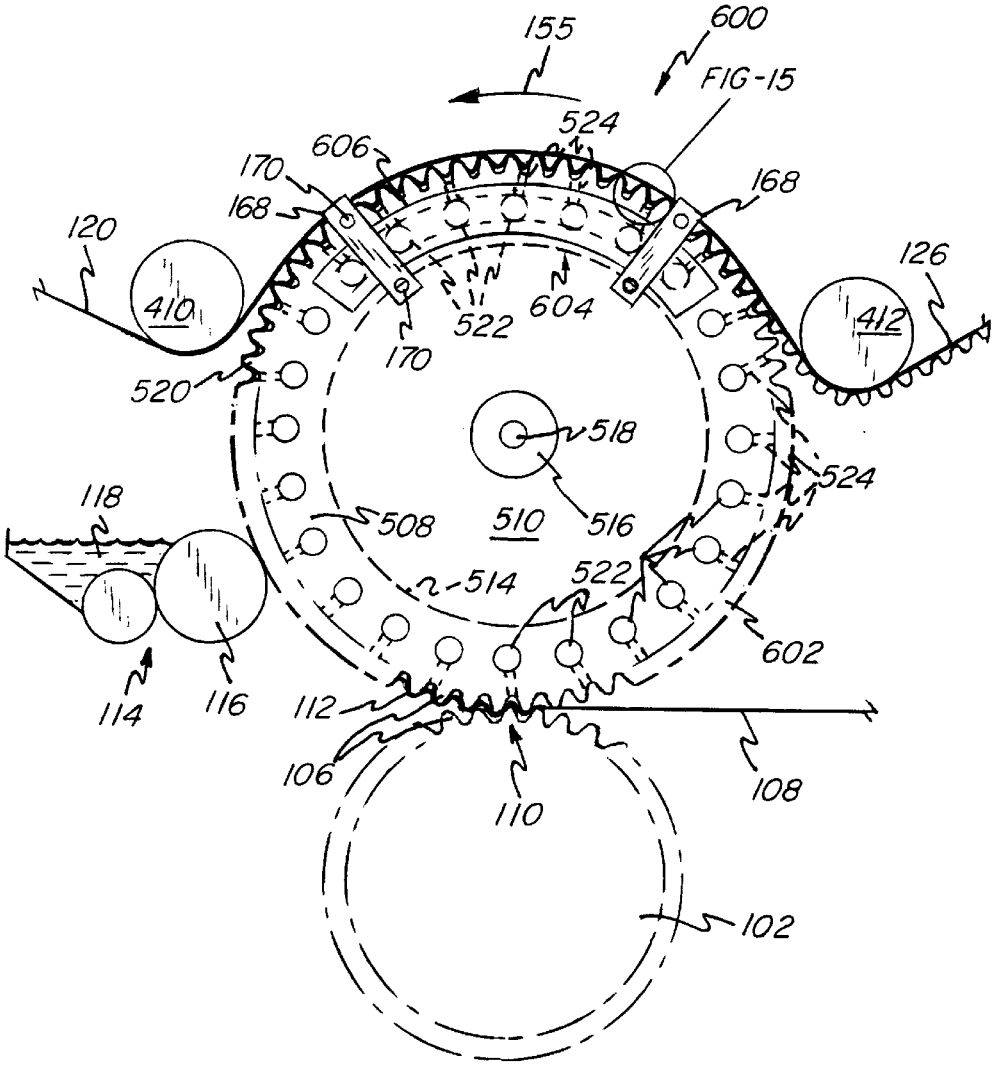
FIG. 14 is a side schematic view of a further embodiment of the single facer of the present invention.

Referring now to FIG. 14, a further embodiment of the single facer 600 of the present invention is illustrated as comprising a carrier corrugating roll 602 of similar design to the carrier corrugating roll 504 as disclosed above with respect to: FIG. 11. However, corrugating roll 602 is of smaller outer diameter and has longitudinally extending teeth 106 which directly mesh with respective teeth 106 of the forming corrugating roll 102 to define a corrugating nip 110. Furthermore, the guiding idler rolls 410 and 412 do not provide for as great of a wrap of the liner web 120 around the outer periphery of the carrier corrugating roll 602. As such, the bonding nip 604 defined between the comer roll 602 and the liner web 120 does not extend the same circumferential distance as that in the FIG. 11 embodiment. Arcuate sealing member 606 likewise has a smaller circumferential distance in the direction of paperboard travel 155. However, the remaining details of the single facer 600 of FIG. 14 are substantially identical to that as disclosed above with respect to the single facer 500 of FIG. 11.

Figure 15:
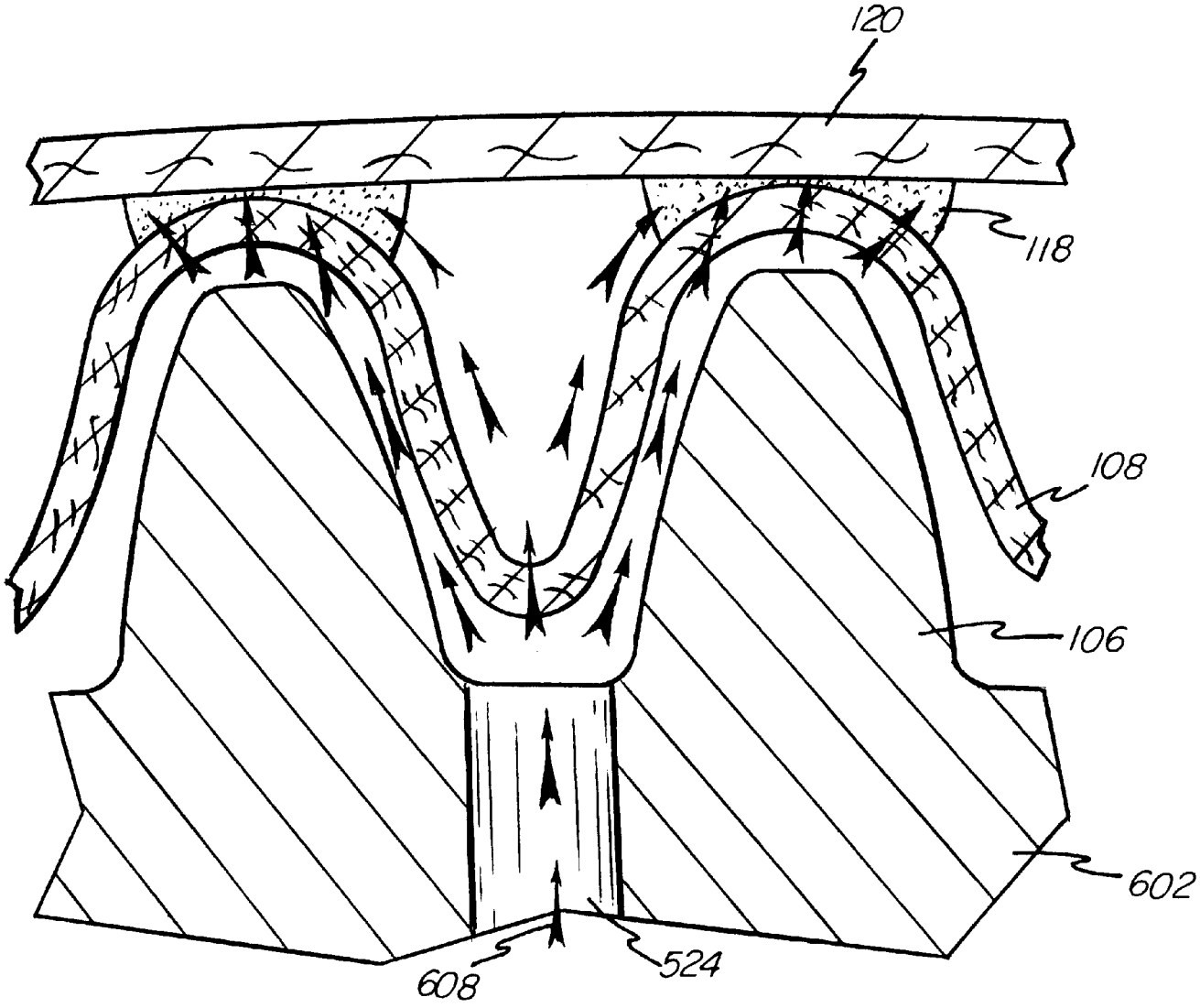
FIG. 15 is a detail view taken along line 15—15 in FIG. 14.

Turning now to FIGS. 14 and 15, the operation of single facer 600 will be described in greater detail. The medium web 108 is supplied to corrugating nip 110 where flutes 112 are formed therein. The medium web 108 is next transferred along the circumference of the carrier corrugating roll 602 to a gluing station 114 where glue 118 is applied to the exposed flutes 112. The medium web 108 is then transported upwardly along the outer circumference of the carrier corrugating roll 602 into contact with a liner web 120 where tension within the liner web 120 from being wrapped around the guiding idler rolls 410 and 412 causes the liner web 120 to press into adhering contact with the glued flutes 112 of the medium web 108.

High pressure steam is supplied to the primary channel 514 of the carrier corrugating roll 602 for heating the outer surface 520 of the cylindrical wall, 508. Heat is transferred from the outer surface 520 of the carrier corrugating roll 602 through the medium web 108 to assist in the gelatinization of the glue 118. Low pressure steam, as represented by arrows 608, is supplied to the passageway 534 formed within the housing 532 of the arcuate sealing member 606 and through the plurality of secondary channels 522. The steam is released through the plurality of fluid ports 524 where a portion of the steam passes through the porous paperboard medium web 108 to the glue 118 between the liner and medium webs 120 and 108. As described above in greater detail, the steam supplies thermal energy to the glue 118 for assisting in the rapid gelatinization thereof.

While the methods herein described, and the forms of apparatus for carrying this method into effect, constitute preferred embodiments of this invention, it is to be understood that the invention is not limited to these precise methods and forms of apparatus, and that changes may be made in either without departing from the scope of the invention, which is defined in the appended claims.

What is claimed is:

1. A single facer comprising:

a forming corrugating roll for corrugating flutes on a medium web;

a carrier corrugating roll operably connected to said forming corrugating roll for carrying the medium web into contact with a liner web;

a bonding nip defined by said carrier corrugating roll for pressing the liner web into adhering contact with the medium web thereby forming a single face web; and a steam supplying device positioned adjacent said carrier corrugating roll and including at least one fluid port, said at least one fluid port facing said carrier corrugating roll and in fluid communication with said bonding nip for supplying a steam against the liner web.

2. A single facer comprising:

a forming corrugating roll for corrugating flutes on a medium web;

a carrier corrugating roll operably connected to said forming corrugating roll for carrying the medium web into contact with a liner web;

a bonding nip defined by said carrier corrugating roll for pressing the liner web into adhering contact with the medium web thereby forming a single face web;

a steam supplying device including at least one fluid port in fluid communication with said bonding nip for supplying a first steam against at least one of the liner web and the medium web; and a pressing device for providing said bonding nip, said pressing device including a cylindrical pressure roll cooperating with said carrier corrugating roll, said at least one fluid port extending radially within said pressure roll through a peripheral surface of said pressure roll.

3. The single facer of claim 2 further comprising a corrugating nip for receiving the medium web, said corrugating nip defined between said forming corrugating roll and said carrier corrugating roll.

4. The single facer of claim 2 further comprising:

an intermediate corrugating roll positioned intermediate said forming corrugating roll and said carrier corrugating roll; and a corrugating nip defined between said forming and intermediate corrugating rolls for receiving the medium web.

5. The single facer of claim 2 wherein said steam supplying device further includes a body having a heated surface facing one of the liner and medium webs.

6. The single facer of claim 5 wherein said heated surface extends circumferentially from proximate a point of initial contact between the liner and medium webs to proximate a point of divergence of the single face web from said carrier corrugating roll.

7. The single facer of claim 5 wherein said steam supplying device further includes:

at least one primary channel extending within said body and in thermal communication with said heated surface; and a first inlet port in fluid communication with said at least one primary channel for supplying a second steam to said at least one primary channel.

8. The single facer of claim 7 wherein said steam supplying device further includes:

at least one secondary channel extending within said body, said at least one secondary channel in fluid communication with said at least one fluid port and in spaced relation to said at least one primary channel; and a second inlet port in fluid communication with said at least one secondary channel for providing said first steam.

9. The single facer of claim 8 further comprising:

a source of said second steam in fluid communication with said at least one primary channel, said second steam comprising a high pressure steam having a pressure between 150 psig and 200 psig and a source of said first steam in fluid communication with said at least one secondary channel, said first steam comprising a low pressure steam having a pressure between 0.5 psig and 10 psig.

10. The single facer of claim 2 wherein said at least one fluid port comprises a plurality of laterally spaced fluid ports arranged in a plurality of longitudinally spaced rows.

11. A single facer comprising:

a forming corrugating roll for corrugating flutes on a medium web;

a carrier corrugating roll operably connected to said forming corrugating roll for carrying the medium web into contact with a liner web;

a bonding nip defined by said carrier corrugating roll for pressing the liner web into adhering contact with the medium web thereby forming a single face web;

a steam supplying device including at least one fluid port in fluid communication with said bonding nip for supplying a first steam against at least one of the liner web and the medium web;

a pressing device for providing said bonding nip, said pressing device including a pair of guiding rolls in spaced relation proximate opposite sides of said carrier corrugating roll for guiding the liner web in pressing contact with the medium web; and wherein said steam supplying device comprises a shoe positioned intermediate said guiding rolls, and said at least one fluid port faces said carrier corrugating roll.

12. The single facer of claim 11 further comprising a corrugating nip for receiving the medium web, said corrugating nip defined between said forming corrugating roll and said carrier corrugating roll.

13. The single facer of claim 11 further comprising:

an intermediate corrugating roll positioned intermediate said forming corrugating roll and said carrier corrugating roll; and a corrugating nip defined between said forming and intermediate corrugating rolls for receiving the medium web.

14. The single facer of claim 11 wherein said at least one fluid port comprises a plurality of laterally spaced fluid ports arranged in a plurality of longitudinally spaced rows.

15. The single facer of claim 11 wherein said steam supplying device further includes a body having a heated surface facing one of the liner and medium webs.

16. The single facer of claim 15 wherein said heated surface extends circumferentially from proximate a point of initial contact between the liner and medium webs to proximate a point of divergence of the single face web from said carrier corrugating roll.

17. The single facer of claim 15 wherein said steam supplying device further includes:

at least one primary channel extending within said body and in thermal communication with said heated surface; and a first inlet port in fluid communication with said at least one primary channel for supplying a second steam to said at least one primary channel.

18. The single facer of claim 17 wherein said steam supplying device further includes:

at least one secondary channel extending within said body, said at least one secondary channel in fluid communication with said at least one fluid port and in spaced relation to said at least one primary channel; and a second inlet port in fluid communication with said at least one secondary channel for providing said first steam.

19. The single facer of claim 18 wherein said second steam comprises a high pressure steam having a pressure between 150 psig and 200 psig and said first steam comprises a low pressure steam having a pressure between 0.5 psig and 10 psig.

20. A single facer comprising:

a forming corrugating roll for corrugating flutes on a medium web;

a carrier corrugating roll operably connected to said forming corrugating roll for carrying the medium web into contact with a liner web;

a bonding nip defined by said carrier corrugating roll for pressing the liner web into adhering contact with the medium web thereby forming a single face web;

a steam supplying device including at least one fluid port in fluid communication with said bonding nip for supplying a first steam against at least one of the liner web and the medium web; and a pressing device for providing said bonding nip, said pressing device including a plurality of rotatably mounted rolls, and an endless belt guided over said plurality of rotatably mounted rolls and cooperating with said carrier corrugating roll; and wherein said steam supplying device comprises a shoe positioned within a run of said endless belt, said at least one fluid port facing said carrier corrugating roll.

21. The single facer of claim 20 further comprising a corrugating nip for receiving the medium web, said corrugating nip defined between said forming corrugating roll and said carrier corrugating roll.

22. The single facer of claim 20 further comprising:

an intermediate corrugating roll positioned intermediate said forming corrugating roll and said carrier corrugating roll; and a corrugating nip defined between said forming and intermediate corrugating rolls for receiving the medium web.

23. The single facer of claim 20 wherein said at least one fluid port comprises a plurality of laterally spaced fluid ports arranged in a plurality of longitudinally spaced rows.

24. The single facer of claim 20 wherein said steam supplying device further includes a body having a heated surface facing one of the liner and medium webs.

25. The single facer of claim 24 wherein said heated surface extends circumferentially from proximate a point of initial contact between the liner and medium webs to proximate a point of divergence of the single face web from said carrier corrugating roll.

26. The single facer of claim 24 wherein said steam supplying device further includes:

at least one primary channel extending within said body and in thermal communication with said heated surface; and a first inlet port in fluid communication with said at least one primary channel for supplying a second steam to said at least one primary channel.

27. The single facer of claim 26 wherein said steam supplying device further includes:

at least one secondary channel extending within said body, said at least one secondary channel in fluid communication with said at least one fluid port and in spaced relation to said at least one primary channel; and a second inlet port in fluid communication with said at least one secondary channel for providing said first steam.

28. The single facer of claim 27 wherein said second steam comprises a high pressure steam having a pressure between 150 psig and 200 psig and said first steam comprises a low pressure steam having a pressure between 0.5 psig and 10 psig.

29. A single facer comprising:

a forming corrugating roll;

a carrier corrugating roll operably connected to said forming corrugating roll for carrying a medium web into contact with a liner web, said carrier corrugating roll having opposing first and second ends;

an intermediate corrugating roll meshing with said forming corrugating roll for corrugating flutes on the medium web;

a corrugating nip for receiving the medium web, said corrugating nip defined between said forming corrugating roll and said intermediate corrugating roll;

a bonding nip defined by said carrier corrugating roll for pressing the liner web into adhering contact with the medium web thereby forming a single face web;

a heated fluid supplying device including at least one fluid port in communication with said bonding nip for supplying a first heated fluid against at least one of the liner web and the medium web;

a pressing device providing said bonding nip, said pressing device including a pair of guiding rolls positioned in spaced relation proximate opposite sides of said carrier corrugating roll for guiding the liner web in pressing contact with the medium web; and wherein said heated fluid supplying device comprises a shoe positioned intermediate said guiding rolls, and said at least one fluid port faces said carrier corrugating roll.

30. The single facer of claim 29 wherein said heated fluid supplying device further includes a heated surface facing one of the liner and medium webs.

31. The single facer of claim 30 wherein said heated surface extends circumferentially from proximate a point of initial contact between the liner and medium webs to proximate a point of divergence of the single face web from said carrier corrugating roll.

32. The single facer of claim 30 wherein said heated fluid supplying device further comprises:

a body defining said heated surface;

at least one primary channel extending within said body and in thermal communication with said heated surface; and a first inlet port in fluid communication with said at least one primary channel for supplying a second heated fluid to said at least one primary channel.

33. The single facer of claim 32 wherein said heated fluid supplying device further comprises:

at least one secondary channel extending within said body, said at least one secondary channel in fluid communication with said at least one fluid port and in spaced relation to said at least one primary channel; and a second inlet port in fluid communication with said at least one secondary channel for providing said first heated fluid.

* * * * *